United States Patent [19]

Kratzer

[11] 4,401,579

[45] Aug. 30, 1983

[54] WATER-BASED METAL FORMING LUBRICANT COMPOSITION AND PROCESS

[75] Inventor: Terry L. Kratzer, Port Huron, Mich.

[73] Assignee: Acheson Industries, Inc., Port Huron, Mich.

[21] Appl. No.: 299,171

[22] Filed: Sep. 3, 1981

[51] Int. Cl.[3] ..... C10M 1/18; C10M 1/26

[52] U.S. Cl. ..... 252/17; 252/18; 252/22; 252/39; 252/41; 252/49.3; 252/49.5; 72/42

[58] Field of Search ..... 252/17, 18, 41, 22, 252/39, 49.3, 49.5; 72/42

[56] References Cited

U.S. PATENT DOCUMENTS

| | | | |
|---|---|---|---|
| 2,349,817 | 5/1944 | Farrington et al. | 252/39 |
| 2,937,993 | 5/1960 | Pattenden et al. | 252/41 |
| 3,466,207 | 9/1969 | Vincent | 156/3 |
| 3,630,789 | 12/1971 | Deyrup | 156/3 |

FOREIGN PATENT DOCUMENTS 2046298 11/1980 United Kingdom .

OTHER PUBLICATIONS

C. C. Vincent, "Bonding Polyethylene to Metal", Journal of Applied Polymer Science, vol. 11, pp. 1553–1562 (1967).

*Primary Examiner*—J. V. Howard

*Attorney, Agent, or Firm*—Harness, Dickey & Pierce

[57] ABSTRACT

A new lubricant composition is disclosed which includes fumaric acid salts as the main lubricating ingredient dispersed in an aqueous medium which also includes an organic thickening agent and other optional materials. A hot forging process utilizing the above lubricant composition is also described.

12 Claims, No Drawings

WATER-BASED METAL FORMING LUBRICANT COMPOSITION AND PROCESS

BACKGROUND OF THE INVENTION

This invention broadly relates to a new waterbased lubricant composition for use in forging operations and to a process of utilizing said composition.

The state of the art is indicated by the following cited references which have resulted from a preliminary search carried out by the applicant: U.S. Pat. Nos. Jain et al 3,983,042; Pattenden et al 2,937,993; Pattenden et al 2,940,930; Pattenden et al 2,898,296; Campbell et al 3,985,662; Farrington et al 2,349,817; Murray et al 3,929,651; Teeter et al 3,507,791; Ruzza et al 3,375,193; Glasson 3,313,729; Kubie 2,921,874; Hodson, Sr. et al 2,735,814; U.K. application publication No. 2,046,298A; British Pat. No. 721,255; British Pat. No. 856,924; and British Pat. No. 995,708.

The environmental and ecological problems associated with oil-based hot forging lubricants have led over the past several years to the development or attempted development of more desirable water-based lubricating compositions for use in forging. Past attempts directed to water-based compositions have involved graphite, clay minerals, iron oxide, and other materials such as molybdenum disulphide, however, these attempts have in most instances not been fully satisfactory for numerous reason, such as, a failure to properly lubricate the forging die under actual operating conditions or, because the water present in the composition did not adequately wet the metal surfaces involved.

Accordingly, a primary object of this invention is to provide a new water based lubricating composition which is highly useful as a lubricant material in various types of forging operations. Another object of this invention is to describe a forging process utilizing the water based lubricating composition disclosed herein. Other objects, features and advantages of the present invention will become apparent from the subsequent description and the appended claims.

SUMMARY OF THE INVENTION

Briefly stated, the present invention involves a lubricant composition suitable for use in hot forging, and made by reacting about 2% to about 30% by weight fumaric acid with about 1% to about 20% by weight of an alkali metal or alkali earth metal hydroxide, about 0.2% to about 5% by weight of a water dispersible organic thickening agent, zero to about 1% by weight of a preservative agent, and the balance water. From a process aspect, the invention comprises the step of contacting the forging dies with an effective amount of the composition described immediately above, then subsequently closing the dies to forge the metal, opening the dies, and removing the forging.

DETAILED DESCRIPTION

According to the invention herein the water-base lubricating composition is comprised of an aqueous solution or dispersion wherein fumaric acid salts are the primary lubricating and release agents.

Other additives may also be used in the composition of this invention, such as organic thickeners, preservative agents, surface active agents, other lubricant materials, suspending agents, dispersing agents, wetting agents, corrosion inhibitors, pigments, dyes and the like.

The water-base lubricating composition as disclosed herein contains alkali metal or alkali earth metal hydroxide in an amount generally sufficient to convert the fumaric acid to the salt form thereof. Sodium hydroxide is the preferred hydroxide material to use for this purpose. It may be used either in particulate form which is commercially available, or it may also be added in the form of an aqueous solution.

Graphite may optionally be used in the composition described herein and, if present, it is normally used within the range of about 3% to about 20% by weight. Finely divided graphite for this purpose is commercially available from a number of different companies. When graphite or other water insoluble materials are incorporated in the composition it is also desirable to include a surfactant material in the composition.

The organic thickener agent used in this invention is selected from the class consisting essentially of water dispersable modified celluloses such as, methyl cellulose, water soluble ether cellulose, sodium carboxymethyl cellulose, ammonium carboxyethyl cellulose, hydroxymethyl cellulose, hydroxyethyl cellulose, carboxypropyl cellulose. Casein and alginates such as sodium alginate are satisfactory thickeners. Bentonite is another satisfactory thickener.

Other suitable water soluble thickeners include polymethacrylates, polyvinyl alcohol, starch, gelatin, gum arabic and polysaccharides.

The preferred organic thickener is hydroxyethyl cellulose, such as is available from Hercules Inc. under the trademark Natrosol 250 HR and 250 HHR.

The thickening agent is present in the composition of this invention at a concentration ranging from about 0.2% to about 5% by weight.

These thickeners assist in solubilizing the other ingredients and enhance adhesion and wetting of the lubricating composition on the surface of the dies or work pieces.

Surface active agents (i.e., surfactants, wetting agents, and dispersing agents) may also advantageously be employed in the aqueous system to assist in wetting the surfaces of the dies and, to disperse and suspend the water insoluble components, such as graphite when it is present, and to level the lubricant composition on the forging pieces and dies. The wetting agents, dispersing agents, emulsifying agents and leveling agents for aqueous systems are well-known.

Examples of such wetting and dispersing agents are: sodium salt of a sulfonated naphthalene condensate (Blancol, manufactured by GAF Corp.); a polyoxyethylene derivative of sorbitan monostearate having a molecular weight of about 1300 (Tween 60, manufactured by ICI Americas Inc.), polyoxyethylene sorbitan monooleate (Tween 80, manufactured by ICI Americas Inc.), sorbitan monostearate (Span 60, manufactured by ICI Americas Inc.), sorbitan monooleate (Span 80, manufactured by ICI Americas Inc.), oxyethylene nonylphenol (Tergitol NPX, manufactured by Union Carbide Corp., composition approximately one mole of oxyethylene per mole of nonylphenol), polyoxyethylene nonylphenol (Tergitol NP14, manufactured by Union Carbide Corp., composition approximately 14 moles of oxyethylene per mole of nonylphenol), polyoxyethylene nonylphenol (Tergitol NP35, manufactured by Union Carbide Corp., composition approximately 35 moles of oxyethylene per mole of nonylphenol), sulfated castor oil, alkyl aryl sulfonate (Duponol G, manufactured by E. I. DuPont de Nemours & Co.), polyoxypropylene glycol (Pluronic L62, manufactured by BASF Wyandotte Corp.), and fatty alkanolamides (Emcol 5100T, manufactured by Witco Chemical Corp.) Other similar surfactants or wetting agents may be used.

In order to achieve a uniform thickness, leveling compounds may be added to the aqueous lubricant to eliminate applicator marks and to provide a smooth, level surface. Examples of such compounds are carboxymethylcellulose, glycerine and ethylene glycol.

The preferred concentration range of surface active agents in the compositions is about 0.5 to 2.0% by weight.

In case of difficult forgings under very high pressures, it sometimes is desirable to include E.P. additives such as molybdenum disulfide, and sodium molybdate.

Performance enhancers may be used in the lubricating compositions to enhance lubrication, to aid as a parting compound and to assist in cooling of the dies by acting as an insulator. Graphite is the most commonly used material of this type. Other suitable materials which may be used are talc, calcium carbonate, mica and magnesium carbonate. Inorganic salts such as sodium nitrite, sodium nitrate and the like, and organic salts such as ammonium acetate, ammonium citrate and the like may also be used. Corrosion inhibitors may be used as an optional ingredient in this invention. Germicides also may optionally be used if desired in the aqueous systems to prevent the growth of bacteria during storage and shipment of the concentrated aqueous systems, and during storage in the feed tanks of the diluted solutions. Dowicil 75, Grotan and sodium omadine are satisfactory germicides. A preferred concentration for germicides is about 0.1% by weight.

Aqueous lubricating compositions of the invention are usually supplied in a concentrated form. The lubricants may be used in the as supplied concentration for some difficult forging operations. In other less difficult forgings, the concentrated lubricant may be diluted with water to fit the particular forging needs. The amount of dilution can only be determined by actual operation of the forging press on the particular work piece. Satisfactory forgings have been made with up to 10 to 15 volumes of water to 1 of the concentrated lubricant.

Although these formulations were developed primarily for use in hot forging processes; other metal forming operations such as drawing, press forming, extrusion, wire drawing and other processes where work piece temperatures reach at least about 800° F. can benefit by the use of these new compositions. The preferred method of application of the composition to the surface of the forming dies or the work piece is by spraying, but swabbing, dipping, and the like may also be used.

If graphite is used in the lubricant composition, it is preferable to dissolve the fumaric acid and alkali metal hydroxide before adding the graphite and organic thickeners. The surface active agents such as dispersants, wetting agents and emulsifying agents should be added before the graphite and organic thickener.

In order to further illustrate the invention the following examples are provided. It is to be understood however that the examples are included for illustrative purposes and are not intended to be limiting of the scope of the invention as set forth in the subjoined claims.

EXAMPLE 1

| | |
|---|---|
| Fumaric Acid | 13.10 |
| Caustic Soda (76%) Beads | 9.20 |
| Organic Thickener* | 1.00 |
| Dye | 0.01 |
| Germicide** | 0.05 |
| Water | Balance |

*Natrosol 250 HR (Hydroxyethyl Cellulose)
**Dowicil 75

EXAMPLE 2

| | |
|---|---|
| Fumaric Acid | 11.0 |
| Caustic Soda (76%) Beads | 7.7 |
| Graphite Powder | 12.0 |
| Organic Thickener* | 1.0 |
| Dispersing Agent** | 0.5 |
| Germicide*** | 0.01 |
| Water | Balance |

*Natrosol 250 HR
**Niaproof No. 7
***Dowicil 75

EXAMPLE 3

| | |
|---|---|
| Sodium Fumarate (Crystals) | 19.00 |
| Organic Thickener* | 1.00 |
| Dye | 0.01 |
| Germicide** | 0.05 |
| Water | Balance |

*Natrosol 250 HR
**Dowicil 75

MANUFACTURING PROCEDURES for Example 1

1. Place water in suitable stainless steel tank.
2. Add the alkali metal hydroxide and stir until dissolved.
3. Add fumaric acid and stir until dissolved.
4. Adjust pH to 7.0–8.5 with additional alkali metal hydroxide or fumaric acid.
5. Add dye and organic thickener; stir until dissolved.
6. Add germicide.

for Example 2

Same as example 1 except stir in the dispersing agent followed by the graphite after adjusting pH and before adding the organic thickener.

for Example 3

1. Add water to a suitable stainless steel tank.
2. Add organic thickener, sodium fumarate, dye, and germicide; stir until uniform.

HOT FORGING TEST

The dies of a 200-ton crankpress were preheated to 500° F. The dies consisted of three stations--mass distribution, perform, and finish. There was no ejector pins in the die cavity which had a draft angle of 2°. The lubricant composition of example 1, diluted with five parts by volume of water, was sprayed on the dies. A 3-kg billet of low carbon steel heated to 2150° F. was advanced to the first die station and was successfully forged into an automotive part with a triple flange.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A water-based lubricant composition, suitable for use in forging, and comprising:

(a) a first portion of a reaction product of about 2% to about 30% by weight fumaric acid and about 1% to about 20% by weight of an alkali metal or alkali earth metal hydroxide, (b) a second portion comprised of modifiers of, about 0.2% to about 5% by weight of a water dispersible organic thickening agent, zero to about 1% by weight of a preservative agent, and (c) the balance water.

2. The composition of claim 1 wherein, the alkali metal hydroxide is sodium hydroxide.

3. The composition of claim 2 wherein, the thickening agent is hydroxethyl cellulose.

4. The composition of claim 1 wherein, the composition is comprised of about 13% fumaric acid, about 9% sodium hydroxide, about 0.8% hydroxyethylcellulose, about 0.15% preservative agent, and a balance of water.

5. An improved process of forging ferrous or non-ferrous metals, comprising the step of contacting the forging dies with an effective lubricating amount of the composition described in claim 1, then subsequently closing the dies to forge the metal, opening the dies, and removing the forging.

6. A lubricant composition, suitable for use in metal forming, and made from about 2% to about 30% by weight sodium fumarate particles, about 0.2% to about 5% by weight of a water dispersible organic thickening agent, zero to about 1% by weight of a preservative agent, and the balance water.

7. An improved process of forging ferrous or non-ferrous metals, comprising the step of contacting the work piece with an effective lubricating amount of the composition described in claim 1, and then subsequently closing the dies to forge the metal, opening the dies, and removing the forging.

8. An improved process of forming ferrous or non-ferrous metals, comprising the step of contacting the forming dies with an effective lubricating amount of the composition described in claim 1, then subsequently forming the metal.

9. An improved process of forming ferrous or non-ferrous metals, comprising the step of contacting the metal work piece to be formed with an effective lubricating amount of the composition described in claim 1 and then subsequently forming the metal work piece.

10. A water-based lubricant composition, suitable for use in forging, and comprising:

(a) a first portion of a reaction product of about 2% to about 30% by weight fumaric acid and about 1% to about 20% by weight of an alkali metal or alkali earth metal hydroxide, (b) a second portion comprised of modifiers of, not less than about 0.2% by weight of water dispersible organic thickening agent, zero to about 1% by weight of a preservative agent, and (c) the balance water.

11. The composition of claim 1 wherein performance enhancers are also used in the composition.

12. The composition of claim 10 wherein performance enhancers are also used in the composition.

* * * * *

UNITED STATES PATENT AND TRADEMARK OFFICE

CERTIFICATE OF CORRECTION

PATENT NO. : 4,401,579

DATED : August 30, 1983

INVENTOR(S) : Terry L. Kratzer

It is certified that error appears in the above-identified patent and that said Letters Patent is hereby corrected as shown below:

Column 1, line 29, "reason" should be --reasons--.

Column 4, line 21 (Example 2) "HR" should be --HHR--.

Column 4, line 56, "200-ton" should be --2000-ton--.

Column 4, line 58, "perform" should be --preform--.

Signed and Sealed this

First Day of November 1983

[SEAL]

*Attest:*

GERALD J. MOSSINGHOFF

*Attesting Officer*

*Commissioner of Patents and Trademarks*